US008081407B2

(12) United States Patent
Willieme et al.

(10) Patent No.: US 8,081,407 B2
(45) Date of Patent: Dec. 20, 2011

(54) COMPACT DISCONNECTOR CIRCUIT-BREAKER FOR AN ALTERNATOR

(75) Inventors: Jean-Marc Willieme, La Mulatiere (FR); Francois Biquez, Brignais (FR); Denis Frigiere, Decines (FR)

(73) Assignee: Areva T&D SA, Paris la Defense Cedex (FR)

( * ) Notice: Subject to any disclaimer, the term of this patent is extended or adjusted under 35 U.S.C. 154(b) by 328 days.

(21) Appl. No.: 12/161,314

(22) PCT Filed: Jan. 15, 2007

(86) PCT No.: PCT/EP2007/050318

§ 371 (c)(1),
(2), (4) Date: Jul. 17, 2008

(87) PCT Pub. No.: WO2007/110251

PCT Pub. Date: Oct. 4, 2007

(65) Prior Publication Data

US 2010/0220417 A1 Sep. 2, 2010

(30) Foreign Application Priority Data

Jan. 17, 2006 (FR) ..... 06 50156

(51) Int. Cl.

| | |
|---|---|
| ***H02H 7/06*** | (2006.01) |
| ***H02H 7/00*** | (2006.01) |
| ***H01H 73/00*** | (2006.01) |
| ***H01H 9/40*** | (2006.01) |
| ***H01H 33/14*** | (2006.01) |

(52) U.S. Cl. ..... 361/20; 361/2; 361/3; 361/115; 218/2; 218/4; 218/6; 218/7

(58) Field of Classification Search ..... 361/2, 3, 361/20, 115; 218/2, 4, 6, 7
See application file for complete search history.

(56) References Cited

U.S. PATENT DOCUMENTS

| | | | | |
|---|---|---|---|---|
| 3,778,573 | A * | 12/1973 | Harrold | 218/118 |
| 5,898,151 | A | 4/1999 | Plat et al. | |
| 5,905,242 | A | 5/1999 | Bernard et al. | |
| 5,952,635 | A | 9/1999 | Plat et al. | |
| 6,013,888 | A | 1/2000 | Thuries | |
| 6,751,078 | B1 * | 6/2004 | Munakata et al. | 361/58 |
| 7,199,324 | B2 | 4/2007 | Perret | |

FOREIGN PATENT DOCUMENTS

| | | | |
|---|---|---|---|
| EP | 0877405 | A1 | 11/1998 |
| EP | 1583124 | A1 | 10/2005 |
| FR | 2738389 | A1 | 3/1997 |

OTHER PUBLICATIONS

French Preliminary Report, Application No. PCT/EP2007/050318, dated Apr. 27, 2007.

* cited by examiner

*Primary Examiner* — Jared Fureman
*Assistant Examiner* — Scott Bauer
(74) *Attorney, Agent, or Firm* — Nixon Peabody LLP

(57) ABSTRACT

An alternator disconnector circuit-breaker of the invention presents a compact structure. The axes of opening/closure of the change-over first switch (12, 14), of the circuit-breaker second switch (22, 24), and of the disconnector switch (32, 34) are such that an angle of 90° is present between two of them. Actuator means (40) associated with synchronization means (52, 54, 56, 58) make it possible to ensure that each switch is operated in a time-shifted manner by common control means.

13 Claims, 4 Drawing Sheets

COMPACT DISCONNECTOR CIRCUIT-BREAKER FOR AN ALTERNATOR

CROSS REFERENCE TO RELATED APPLICATIONS OR PRIORITY CLAIM

This application is a national phase of International Application No. PCT/EP2007/050318, entitled "A COMPACT DISCONNECTOR CIRCUIT-BREAKER FOR AN ALTERNATOR", which was filed on Jan. 15, 2007, and which claims priority of French Patent Application No. 06 50156, filed Jan. 17, 2006.

TECHNICAL FIELD

The invention relates to the field of electrical switchgear equipping devices for taking energy from alternators in power stations. The invention relates to arranging the various switch elements so that the alternator circuit-breakers are of more compact structure.

More particularly, the invention relates to an alternator circuit-breaker coupled to a disconnector, in which circuit-breaker the various relative movements of the contacts take place on axes or in planes that are intersecting.

STATE OF THE PRIOR ART

At the outlet of the power station, e.g. for each alternator, one safety option is to dispose a circuit-breaker making it possible to isolate the circuit in question before the transformer connected to a power line. That type of switchgear, under a voltage in the range approximately 15 kilovolts (kV) to approximately 36 kV, then performs the functions of passing high permanent current (of the order of a few thousand amps) and of breaking high fault current (of the order of a few tens of thousands of amps), while isolating the circuit.

In view of the magnitude of the rated nominal current in the circuit, the circuit-breaking is performed in two stages by means of two switches in parallel, one of which passes the rated permanent current and the other of which breaks the short-circuit current, thereby defining a "main circuit" and an "auxiliary circuit". Although their principle is, in principle, similar to the principle of other circuit-breakers, and in particular to the principle of high-voltage and very high voltage hybrid circuit-breakers, alternator switch devices are thus subjected to power stresses that make it impossible to apply the same designs, as regards the arrangement and actuation of the various elements.

The contacts of the switch of the main circuit for such alternator circuit-breakers are heavy enough to withstand high rated currents without overheating, and they define a relatively large volume. The circuit-breaker switch conventionally comprises a small-size chamber disposed inside said volume and having arcing contacts that are mounted to move relative to each other and that, de facto, withstand only the circuit-breaking current of the circuit-breaker.

Usually, the contacts of the two switches extend in the same longitudinal direction and are moved in translation parallel to said direction; firstly the main contacts move apart and travel sufficiently before the current switches over to the arcing contacts, which then open and cause the current to be broken.

It is usual for the alternator circuit-breaker also to include a disconnector, which has no circuit-breaking power: the disconnector opens only when the circuit-breaker is open and thus when current is no longer passing through the circuit. Such a power station disconnector circuit-breaker is described, for example in Document EP 0 877 405.

The shapes of alternator circuit-breakers are, however, complex to implement, in particular since the constraints for the dimensioning of the various switch elements and for the way they are actuated must be complied with strictly. In addition, the resulting structure is of large size.

SUMMARY OF THE INVENTION

An object of the invention is to make alternator circuit-breakers more compact while enabling them to retain the same properties.

More particularly, in one of its aspects, the invention provides an alternator disconnector circuit-breaker comprising a change-over switch, e.g. a circuit-breaker, in parallel with a circuit-breaker switch, e.g. a vacuum chamber, and a disconnector switch, advantageously in series with the change-over switch; each of the switches has a pair of contacts that are mounted to move relative to each other along a respective axis or by pivoting about a pivot, e.g. by means of an actuator bar coupled to actuator means. The circuit-breaker further comprises synchronization means making it possible, while breaking, for the contacts to separate successively in the following order: the contacts of the change-over switch, then the contacts of the circuit-breaker switch, and then the contacts of the disconnector; preferably, the synchronization means also make it possible for the contacts to be re-closed in the reverse order. Preferably, the same control means include said synchronization means and make it possible, by common control means, to implement each of the elements.

In the invention, in order to make the circuit-breaker compact, the axes of the switches are not mutually parallel. In particular, in a preferred embodiment, the contacts of each of the three switches are moved in relative translation along a respective axis, two of the axes intersecting, preferably with the circuit-breaker switch being disposed at right angles relative to the change-over switch and to the disconnector switch. In another preferred embodiment, the first and second switches have contacts that move in translation along intersecting axes, it being possible for the contacts of the disconnector to move in the plane defined by them, or in an orthogonal plane, for example.

In, another aspect, the disconnector switch is associated with an insulator, fully or partially, so as to add a function of inserting an arc in series with the circuit-breaker switch. In which case, an additional stage can take place during the opening sequence, with an arc striking at the disconnector, prior to circuit-breaking proper: the synchronization means are adapted so that firstly the main contacts are separated, then the disconnector is opened slightly so that an arc strikes when the vacuum chamber is opened, which takes place immediately. The disconnector is then opened fully: the insulator is present so as to protect the other parts from the electric arc.

BRIEF DESCRIPTION OF THE DRAWINGS

The characteristics and advantages of the invention will be better understood on reading the following description with reference to the accompanying drawings, which are given by way of non-limiting illustration, and in which.

DETAILED DESCRIPTION OF PARTICULAR EMBODIMENTS

Figure 1:
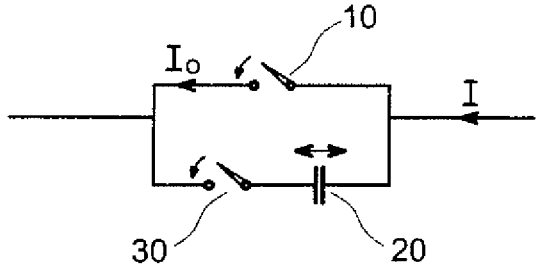
FIG. 1 diagrammatically shows the circuit-breaking principle of a disconnector circuit-breaker of the invention.

The operating principle of a circuit-breaker, and in particular of an alternator circuit-breaker of the invention, is shown diagrammatically in FIG. 1, with a main circuit in which a current $I_0$ close to the rated current I flows when in operation, and an auxiliary circuit that is used for breaking a short-circuit.

For an alternator circuit-breaker, passing a current I of rated magnitude greater than a few thousand amps requires a switch 10 whose contacts are particularly conductive, e.g. made of copper, to be used on the main circuit; the breaking power of those contacts is, however, limited due to electric arcs striking. A circuit-breaker second switch 20 is put in parallel with the first switch 10 in order to perform the circuit-breaking function proper, the first switch 10 opening causes, de facto, the current I to be switched over from the main circuit to the auxiliary circuit; the contacts of said second switch 20 that are, for example, made of tungsten, are of limited performance as regards passing the rated current I, but have high breaking power.

Thus, the functions of passing the permanent current and of breaking short-circuit current are separated: when such circuit-breaking is necessary, firstly the first switch 10 is activated, all of the current I then going over to the auxiliary circuit and causing the second switch 20 to be opened so as to obtain the circuit-breaking function. In addition, a third switch 30 is then opened: its function is mainly a safety function, its association on the auxiliary circuit making it possible to avoid a reduction in the dielectric strength of the second switch 20 that might accidentally allow current to pass into the associated branch.

In order to re-close such a circuit-breaker, the reverse order applies: firstly the disconnector 30 is re-closed, then the circuit-breaker switch 20 is re-closed, and finally the first switch 10 is re-closed.

Each of the switches 10, 20, 30 has a pair of contacts that are mounted to move relative to each other; advantageously, the first contact 12, 22, 32 of each pair is stationary, and the second contact 14, 24, 34 is a moving contact that is mounted to move relative to the first contact. In a first embodiment show in FIG. 2, each of the moving contacts moves in translation along a respective axis AA, BB, CC.

In particular, the first switch 10 can be of the gas type; it can also, if the rated current is very high, itself be switchgear comprising two switches put in parallel with each other. Preferably, however, as shown, the first switch 10 is an air-insulated switch having a tubular first contact 12 into which a second contact 14 that is also tubular can be inserted. Said first switch 10 can be actuated by any known means, in particular by control means 40 activating an actuator bar 42 coupled to the moving contact 14 that is mounted to move in translation.

The second switch 20 can be a gas-insulated circuit-breaker containing a gas of the sulfur hexafluoride ($SF_6$) type; preferably, since the current $I-I_0$ passing through it is low under normal operating conditions, it is a vacuum chamber: this makes it possible to avoid using $SF_6$ which does not satisfy all ecological criteria, and reduces the costs. The moving contact 24 of the second switch 20 is moved by means of an actuator bar 44 mounted to move along the axis BB.

Finally, the third switch 30 can, in one embodiment, have a stationary contact 32 into which another moving contact 34 of the rod type can be inserted along the opening/closure axis CC. The rod 34 can be moved via a bar 46 in translation.

Preferably, the same control means 40 make it possible to move the first, second, and third moving contacts 14, 24, and 34. To this end, the control means 40 are connected functionally to each of the actuators 42, 44, 46, and include synchronization means 50 making it possible to defer the relative openings of the switches 10, 20, 30.

In the invention, although each actuator bar 42, 44, 46 of this embodiment moves in translation and is secured to the same control means 40, the three opening/closure axes AA, BB, CC are not necessarily parallel, at least one of them intersecting the first axis AA, for example. For reasons of compactness, it is preferable to dispose at least one axis BB at an angle of about 90° relative to the first axis AA. Although this configuration requires different arrangements of the pairs of contacts 12, 14; 22, 24; 32, 34 and of the means 42, 44, 46 for moving them, it appears that this configuration, which is in principle dismissed for reasons of complexity of the synchronization, can be chosen.

For example, the synchronization means 50 can thus comprise a groove in the actuator bar 42 of the first switch 10, which groove is generally longitudinal along the axis AA of the bar but has a slanting portion, the groove being associated with an element of the lug 54 type integral with the second actuator bar 44, so that, in a first stage, while the first moving contact 14 is moving, the position of the lug 54 is moved so as to move the second moving contact 24 away from the second stationary contact 22.

Figure 2:
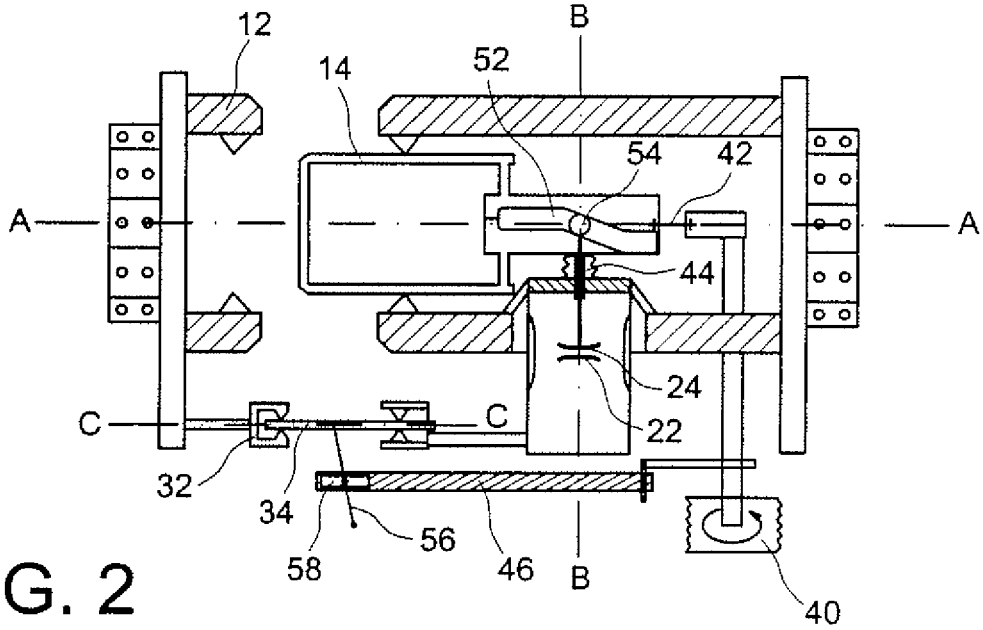
FIG. 2 shows a preferred embodiment of the circuit-breaker of the invention.

It can be advantageous for the axes AA, CC of the change-over switch 10 and of the disconnector 30 to be parallel, as shown in FIG. 2, but other options are possible, as described below. The synchronization means 50 can have a system similar to the preceding system 52, 54 for deferring opening of the disconnector 30 relative to opening of the circuit-breaker switch 20; it is however preferable for the synchronization means 50 to be associated directly between the first and the third switches 10, 30. For example, the synchronization means 50 comprise a lever arm 56 coupled at an end portion to the third moving contact 34 and whose pivot axis is associated with a groove 58 located in the actuator bar 46 of the third switch 30: the actuator bars 42, 46 of the first and third switches 10, 30 are moved jointly by the actuator means 40, but a delay in moving the third contact 34 is generated by the latency before the lever 56 pivots.

Other actuation and synchronization solutions are naturally imaginable.

In particular, as shown in FIG. 3, the disconnector switch 30' can operate on another principle of the "knife-switch" type. In the alternator circuit-breaker shown, the main switch 10' has two contacts 12', 14' that are mounted to move relative to each other in translation, an that are disposed in a casing such as a tube that is 200 millimeters (mm) in diameter; in an operating position shown in FIG. 3A, the alternator current $I_0$ flows through this main circuit (see arrow).

When circuit-breaking is required, the two contacts 12', 14' move apart: actuation is effected by means of a bar 42'. In a first stage shown in FIG. 3B, the current I continues to flow along its main path, but an arc strikes across the distance between the two contacts 12', 14' of the switch 10'; then the circuit-breaking on the main circuit is completed (FIG. 3C), and the current flows through the auxiliary circuit only, the delay means 50' having deferred opening of the contacts 22', 24' of the circuit-breaker switch 20'. For example, the dielectric distance on the main circuit makes it possible to withstand the transient re-strike voltage, i.e. the actuator bar 42' moves over about one half of its total stroke before the vacuum chamber 20' opens.

Figure 3A:
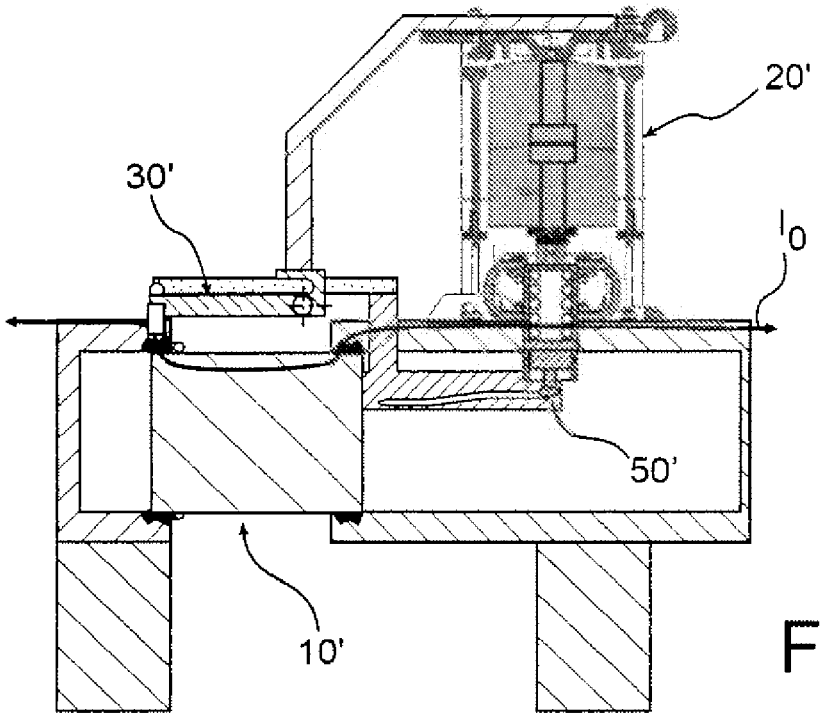
FIGS. 3A to 3F show a circuit-breaking sequence for another embodiment of an alternator circuit-breaker of the invention.
Figure 3B:
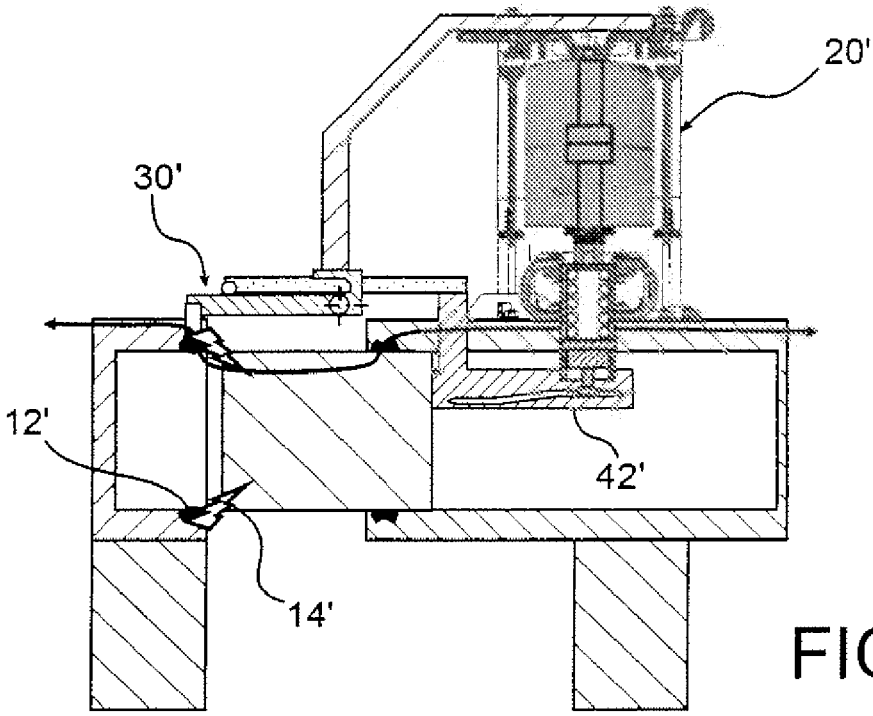
Figure 3C:
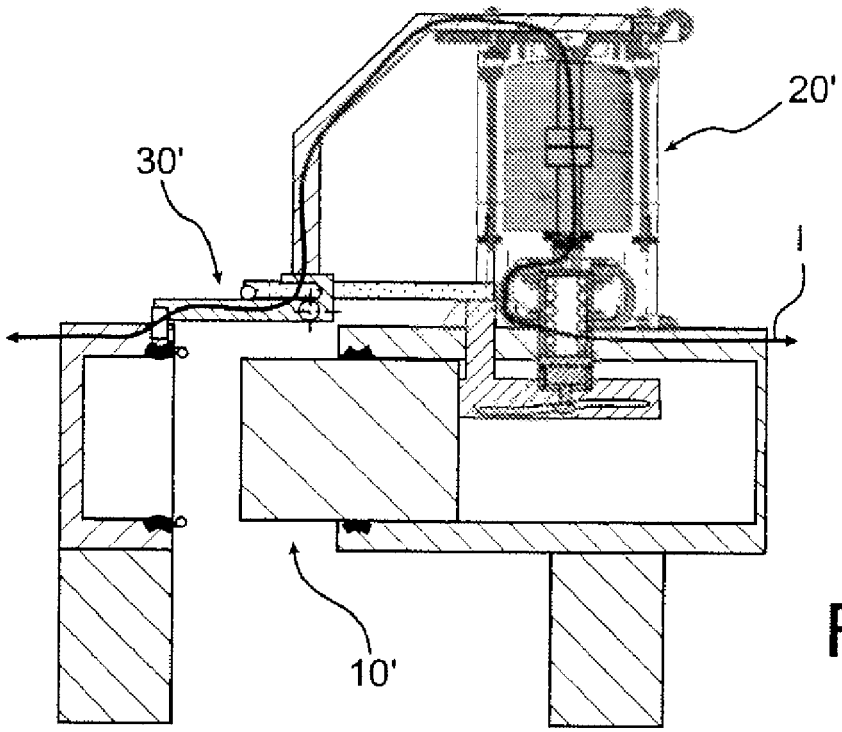
Figure 3D:
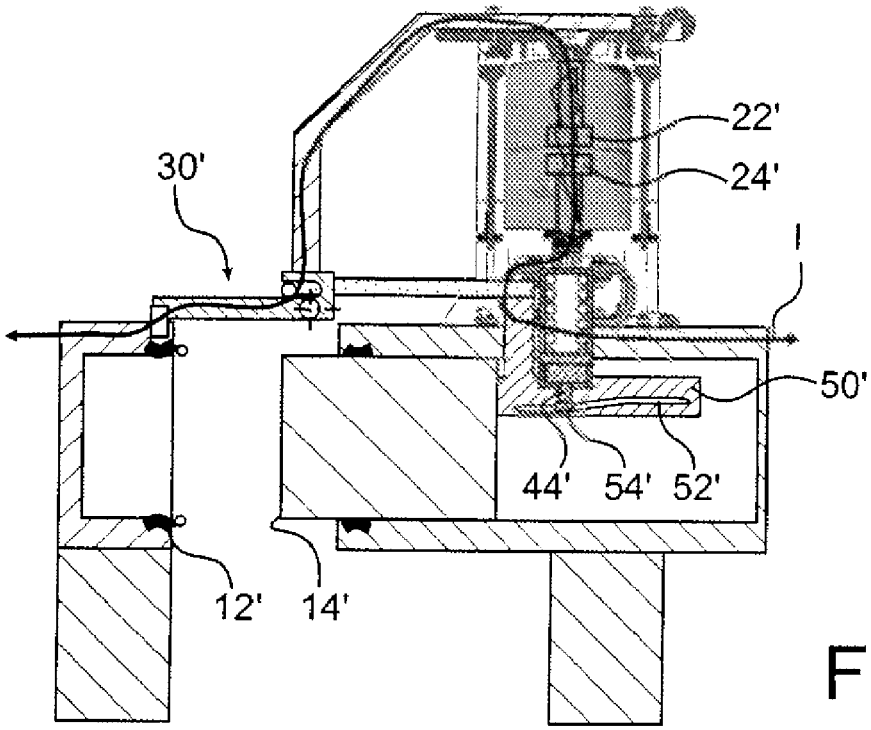
Figure 3E:
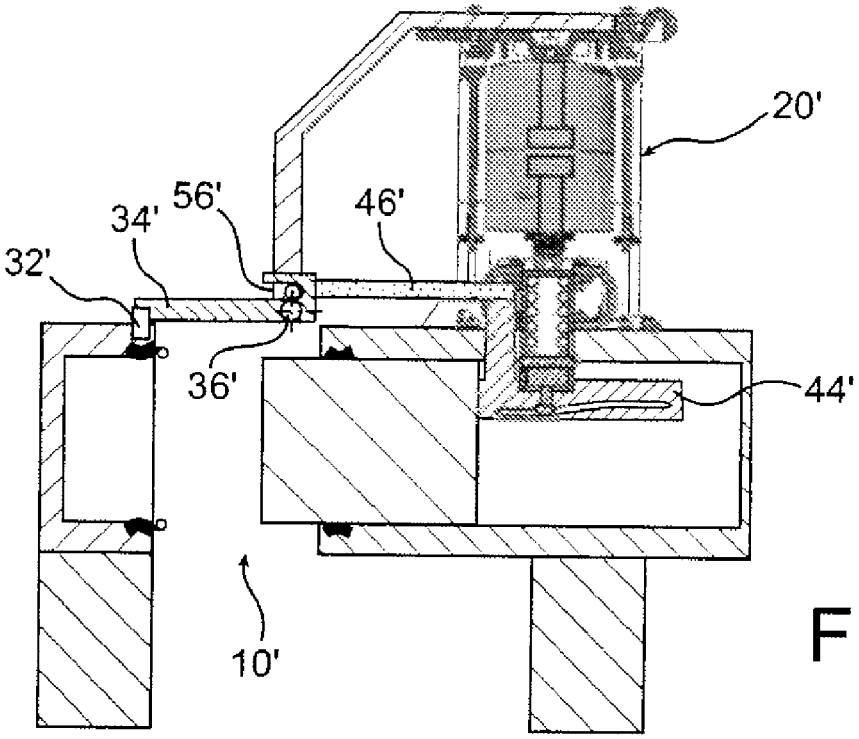

In order to break the short-circuit current, the two relatively moving contacts 22', 24' of the circuit-breaking chamber 20' move relative to each other in translation along an axis orthogonal to the translation axis of the first switch 10': FIG. 3D. The two contacts 22', 24' are moved relative to each other by means of an actuator bar 44' that is orthogonal to the bar 42', and that is secured thereto via delay means 50', e.g. by means of a lug 54' moving in a groove 52' in the first actuator bar 42'. While the contacts 22', 24' are moving apart, an arc strikes, and then, very rapidly, circuit-breaking is completed: FIG. 3E.

Figure 3F:
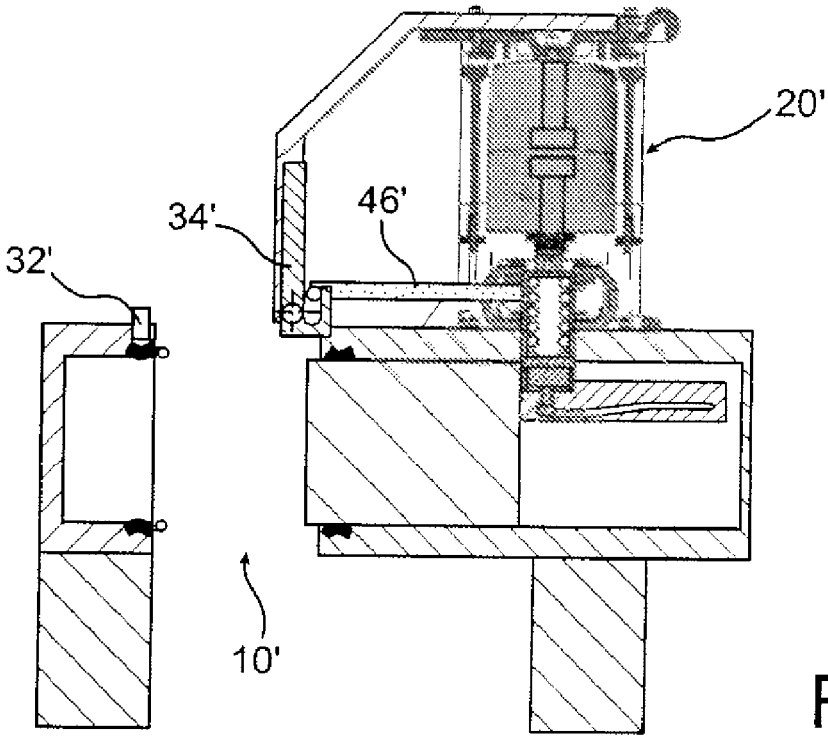

During these stages, and by means of the delay means 50', the disconnector switch 30' is not actuated. The stationary contact 32' of the disconnector 30' is secured to the stationary contact 12' of the first switch; the second contact 34' of the disconnector 30' is mounted to move relative to the stationary contact by pivoting about an axis 36'. The actuator means 46' for actuating the contacts 32', 34' of said switch 30' are secured to the first bar 42; in addition, at the pivot 36', the moving contact 34' is provided with delay means 56' in the form of a groove that is complementary to a lug on the actuating bar 46', but that enables the lug to move relative thereto before the contact 34' is driven by the bar 46' in rotation about its axis 36'; finally, as shown in FIG. 3F, the disconnection is completed.

Naturally, other actuations are possible: for example, the disconnector 30' can also move in a "horizontal" plane, i.e. in the context shown, by pivoting about an axis 36' that is parallel to one of the translation axes of the contacts of the other two switches 10', 20'.

Figure 4:
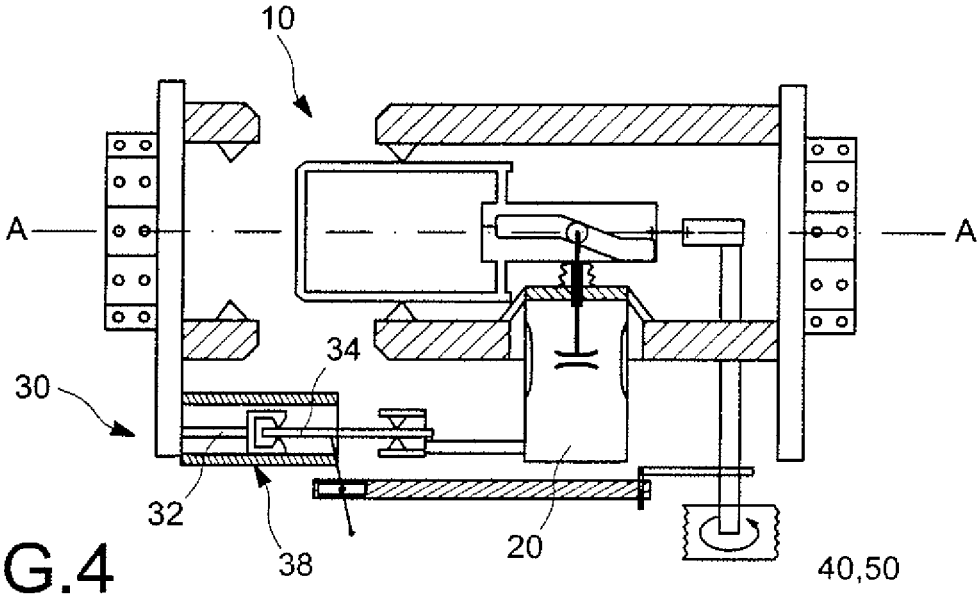
FIG. 4 shows an alternative to the embodiment shown in FIG. 2.

In a variant, it is possible to position the disconnector 30 in an insulator 38, or in a screen, as shown in FIG. 4 for the first embodiment of the circuit-breaker. The insulator 38 can be stationary, or secured to the rod 34 of the disconnector 30; it makes it possible, de facto, via the disconnector 30, to insert an arc in series with the vacuum chamber 20 and to prevent said arc from degenerating to ground. This alternative is particularly advantageous for circuit-breaking with very long arcing times (as applies for delayed zero current breaking), and improves the breaking capacities. It is then preferable for the disconnector 30 to be slightly open when the vacuum chamber 20 opens, with an arc striking at said disconnector once the main contacts 10 are separated. In which case, the vacuum chamber 20 is subjected to less stress, since the insulator 34 makes it possible to protect said vacuum chamber, and the other parts of the circuit-breaker, from the electric arc.

The invention claimed is:

1. An alternator disconnector circuit-breaker comprising:

a main circuit including a first switch having a first pair of contacts that are mounted to move relative to each other in translation along a first axis;

an auxiliary circuit in parallel with the main circuit, the auxiliary circuit including:

a second switch which is a circuit-breaker switch having a second pair of contacts that are mounted to move relative to each other in translation along a second axis intersecting the first axis; and a third switch which is a disconnector switch having a third pair of contacts mounted to move relative to each other in translation along a third axis parallel to and non-intersecting with the first axis; and synchronization means making it possible, while breaking, for the contacts of the first switch to separate before the contacts of the second switch separate, said contacts of the second switch themselves separating before the third contacts separate fully.

2. An alternator disconnector circuit-breaker according to claim 1, in which the third axis is substantially parallel to the first axis.

3. An alternator disconnector circuit-breaker comprising:

a main circuit including a first switch having a first pair of contacts that are mounted to move relative to each other in translation along a first axis;

an auxiliary circuit in parallel with the main circuit, the auxiliary circuit including:

a circuit-breaker second switch having a second pair of contacts that are mounted to move relative to each other in translation along a second axis intersecting the first axis; and a disconnector third, knife-type switch having a third pair of contacts mounted to move relative to each other; and synchronization means making it possible, while breaking, for the contacts of the first switch to separate before the contacts of the second switch separate, said contacts of the second switch themselves separating before the third contacts separate fully.

4. A circuit-breaker according to claim 1, in which the third switch is connected electrically in series with the second switch, and, together, they are connected electrically in parallel with the first switch.

5. A circuit-breaker according to claim 1, in which the second axis forms an angle substantially equal to 90° relative to the first axis.

6. A circuit-breaker according to claim 1, in which each pair of contacts is associated with an actuator bar that is mounted to move under the action of control means.

7. A circuit-breaker according to claim 1, further comprises control means which include the synchronization means so as to defer separation of the pairs of contacts, the control means being common control means for all three switches.

8. A circuit-breaker according to claim 1, in which the synchronization means are configured to separate the contacts in the following order: the contacts of the first switch, then the contacts of the second switch, and then the contacts of the third switch.

9. A circuit-breaker according to claim 8, in which the synchronization means are configured to re-close the contacts of the switches successively in the reverse order to the order in which they separate.

10. A circuit-breaker according to claim 1, in which the second switch is a vacuum chamber.

11. A circuit-breaker according to claim 1, in which the second switch is a vacuum chamber and the third switch includes an insulator or a screen in a manner such as to insert an arc in series with the vacuum chamber.

12. A circuit-breaker according to claim 11, in which the synchronization means are operative to separate the contacts of the first switch before the contacts of the third switch separate partially so as to cause an arc to strike almost simultaneously with separation of the contacts of the second switch, the synchronization means then enabling the third contacts to separate totally.

13. A circuit-breaker according to claim 3, in which the contacts of the third pair are mounted to move relative to each other by pivoting about an axis.

* * * * *